US005331878A

United States Patent [19]

Kurosaki

[11] Patent Number: 5,331,878

[45] Date of Patent: Jul. 26, 1994

[54] CONNECTING UNIT OF A STAND FOR PERCUSSION MUSICAL INSTRUMENTS

[75] Inventor: Makoto Kurosaki, Shizuoka, Japan

[73] Assignee: Yamaha Corporation, Japan

[21] Appl. No.: 985,585

[22] Filed: Dec. 3, 1992

Related U.S. Application Data

[63] Continuation-in-part of Ser. No. 970,261, Nov. 2, 1992.

[30] Foreign Application Priority Data

Oct. 31, 1991 [JP] Japan ..... 3-89933

[51] Int. Cl.[5] ..... G10D 13/02

[52] U.S. Cl. ..... 84/421; 248/122; 248/185

[58] Field of Search ..... 84/421; 403/83, 84, 403/86, 91, 93, 96, 101, 104, 161, 162, 163, 383; 248/122, 185, 291

[56] References Cited

U.S. PATENT DOCUMENTS 4,047,684 8/1977 Kobayashi ..... 248/122

4,141,272 2/1979 Yanagisawa ..... 84/421

4,363,561 12/1982 Hsieh ..... 84/421 X

*Primary Examiner*—Michael L. Gellner

*Assistant Examiner*—P. J. Stanzione

*Attorney, Agent, or Firm*—Ostrolenk, Faber, Gerb & Soffen

[57] ABSTRACT

In construction of a connecting unit of a stand for percussion musical instruments such as snare drums, a clutch base at one end of the first supporting element is coupled, via cylindrical projection/circular bore engagements, to a clutch arm at one end of the second supporting element, an arm base is coupled, via square projection/square depression engagement, to the clutch base while sandwiching the clutch arm, and the three elements are fastened together in the direction of their combination. The cylindrical projection/circular bore engagement allows free combination of the two supporting elements at any selected cross angle whereas the square projection/square depression engagement assures long maintenance of the combination despite frequent application of vibrations.

2 Claims, 8 Drawing Sheets

CONNECTING UNIT OF A STAND FOR PERCUSSION MUSICAL INSTRUMENTS

This is a continuation-in-part of Ser. No. 07/970,261, filed Nov. 2, 1992, still pending.

BACKGROUND OF THE INVENTION

The present invention relates to a connecting unit of a stand for percussion musical instruments, and more particularly relates to improvements in mode of connection between cooperating supporting elements of a stand used for holding percussion musical instruments such as snare drums and cymbals.

In one conventional connecting system used for such applications, a connecting unit includes a crown shaped connecting element which is fixed to one end of a supporting element and provided on one axial end with peripheral serrations. When two supporting elements are to be joined together at a selected cross angle, serrations on connecting elements of respective supporting elements are combined together in an angular relationship corresponding to the selected cross angle. The combination is then fastened by cooperation of a screw and a nut attached to the combination.

In another conventional connecting system used for similar applications, one end of a tubular supporting element (first supporting element) is provided with a sectral section which has a sectral opening in its central area. A pair of connecting elements (first connecting elements) are idly connected at their one ends to the proximal area of the sectral section of the tubular supporting element via proper spacers. Another cylindrical supporting element (second supporting element) is connected at one end to the proximal end of a U-shaped connecting element (second connecting element). When the two supporting elements are to be joined together at a selected cross angle, the sectral section of the first supporting element is sandwiched by two branched of the second connecting element in an angular relationship corresponding to the selected cross angle. A joint between the first supporting element and the first connecting elements are the screw fastened. Concurrently, a joint between the second supporting element and the second connecting element in also screw fastened.

In a further conventional connecting system used for like applications, a tubular supporting element (first supporting element) is provided at one end with a frustconical connecting element (first connecting element) having a center projection. Another supporting element (second supporting element) is provided at one end with a disc shaped connecting element (second connecting element) having a conical center hollow. When the two connecting elements are to be joined together at a selected cross angle, a conical rubber piece is attached over the center projection of the first connecting element and the second connecting element is put into combination with the first connecting element via the rubber piece in an angular relationship corresponding to the selected cross angle. Finally, the combination is screw fastened.

In the case of the first conventional example, the degree of cross between the two supporting elements is limited by the serration pitch on the connecting element. That is, this conventional system is very poor in freedom of selection of the cross angle. No continuous change in cross angle is permitted.

The second conventional example appears to allow continuous change in cross angle between the two supporting elements. In practice, however, the degree of cross angle is limited by the shape of the sectoral section of the first supporting element. In addition, the screw fastening the joints is rather unstable and much vurnerable to vibrations. Stated otherwise, the original cross angle is liable to be lost during long use.

Fastening in the third conventional example is totally dependant upon rubber friction only, which cannot assure reliable combination for a long period. Not only frequent vibrations but also rubber aging seriously degrades fastening power.

SUMMARY OF THE INVENTION

It is the object of the present invention to provide a reliable connecting unit of a stand for percussion musical instruments which allows free change in cross angle and well endures vibrations during long use.

In accordance with the basic aspect of the present invention, a clutch base at one end of the first supporting element is coupled, via cylindrical projectional circular bore engagement, to a clutch arm at one end of the second supporting element, an arm base is coupled, via square projection/square depression engagement, to the clutch base whilst sandwiching the clutch arm, and the three elements are fastened together in the direction of their combination.

DESCRIPTION OF THE PREFERRED EMBODIMENTS

Figure 1:
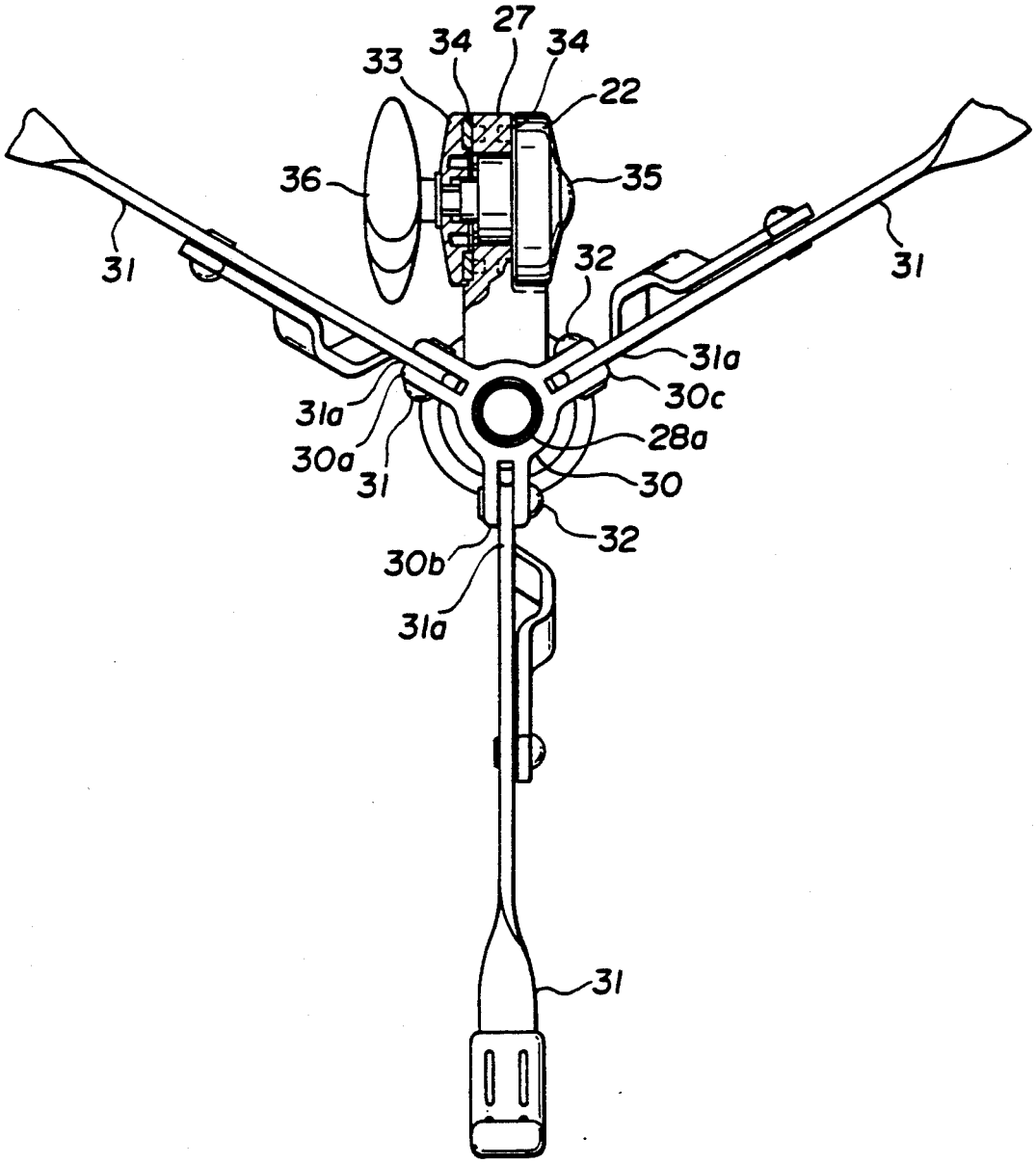
FIG. 1 is a top plan view of a drum stand incorporating one embodiment of the connecting unit in accordance with the present invention.
Figure 2:
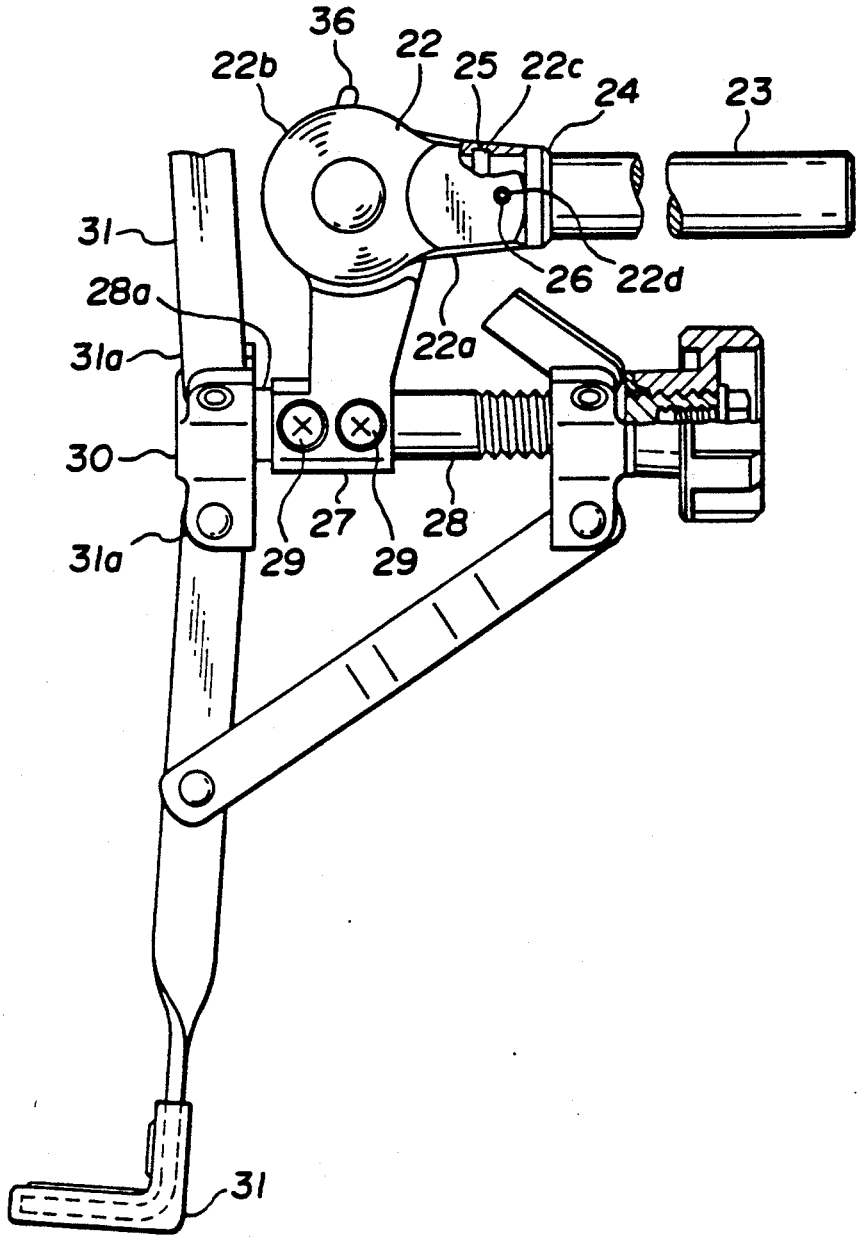
FIG. 2 is one side plan view, partly in section, of the main part of the drum stand shown in FIG. 1.
Figure 3:
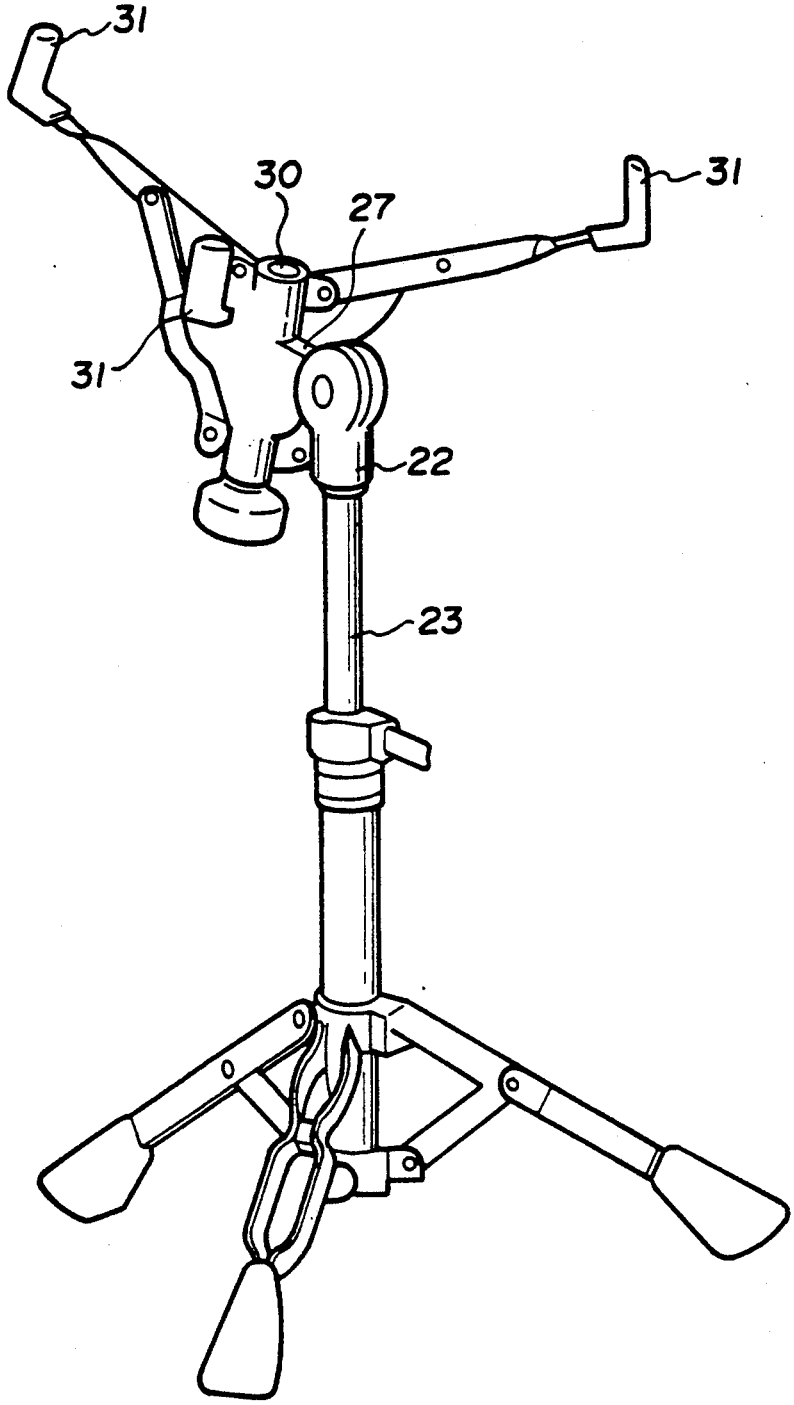
FIG. 3 is a perspective plan view of the stand shown in FIG. 1, FIGS. 4A to 4C are various plan views of a one example of a clutch base used for the connecting unit shown in FIGS. 1 to 3, FIGS. 5A to 5C are different various plan views of the clutch base shown in FIGS. 4A to 4C, FIGS. 6A to 6D are various plan views of another example of a clutch base used for the connecting unit shown in FIGS. 1 to 3, FIGS. 7A to 7B are different various views of the clutch base shown in FIGS. 6A to 6D, FIGS. 8A to 8C are various plan views of a clutch cap used for the connecting unit shown in FIGS. 1 to 3, and FIGS. 9A and 9B are top and side sectional plan views of a clutch rubber used for the connecting unit shown in FIGS. 1 to 3.

One embodiment of the connecting unit in accordance with the present invention is generally shown in FIGS. 1 to 3, in which a tripod type supporting system is exemplified. The connecting unit includes, as major elements, a clutch base 22 mounted atop an upper pipe 23 of a stand, a clutch arm 27 coupled to the clutch base 22, an arm holder shaft 28 held by the clutch arm 27 and an arm base 30 fixed to the top end of the arm holder shaft 28.

Figure 4A:
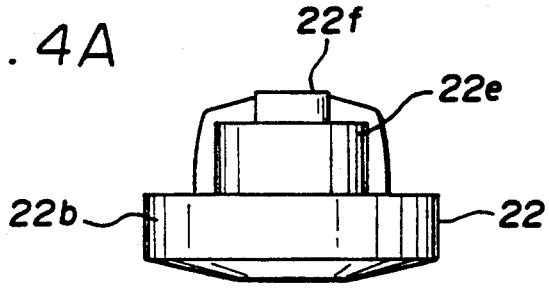
Figure 4B:
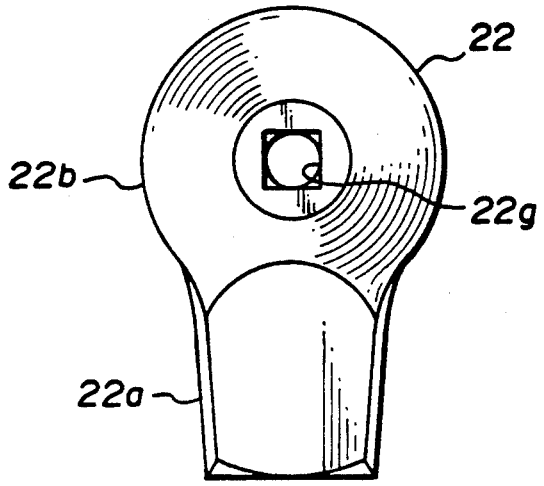

The clutch base 22 is preferably made of, for example, a zinc die cast and its construction is shown in detail in FIGS. 4A to 4C and 5A to 5C, respectively. The clutch base 22 is made up of a coupling section 22*a* and a connecting section 22*b* formed in one body with each other as best seen in FIG. 4B. The coupling section 22*a* is adapted for combination with the upper pipe 23 of the stand whereas the connecting section 22*b* is adapted for combination with the clutch arm 27. The bores 22*c* and 22*d* are formed in the coupling section. For combination of the clutch base 22 with the upper pipe 23 of the stand, a damper ring 24 made of an elastic material such as rubber is first inserted into the coupling section 22*a* of the clutch base 22, the top end section of the upper pipe 23 is force inserted into the coupling section 22*a* through the damper ring 24 as shown in FIG. 2 and spring bins 25 and 26 are inserted into the bores 22*c* and 22*d* in order to fix the combination.

Figure 4C:
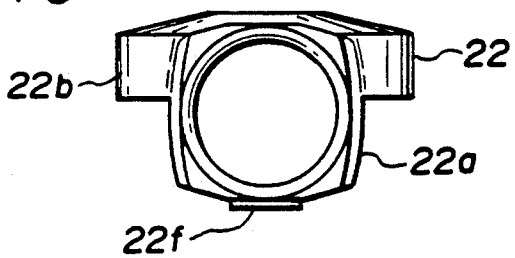
Figure 5A:
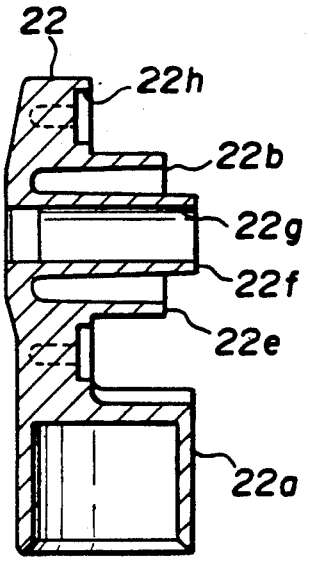
Figure 5B:
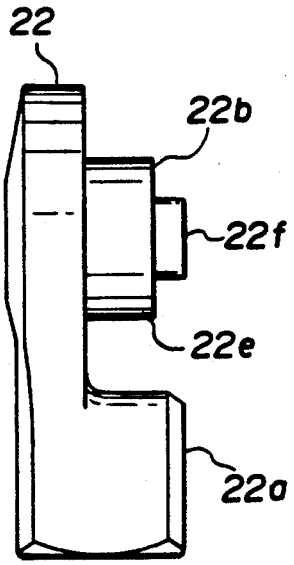
Figure 5C:
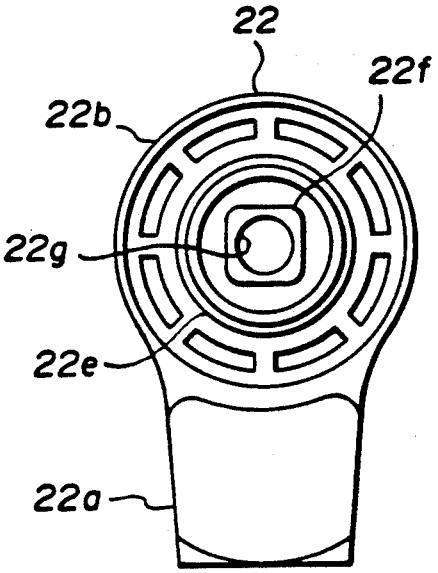
Figure 6B:
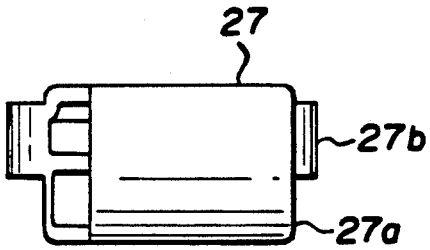
Figure 6A:
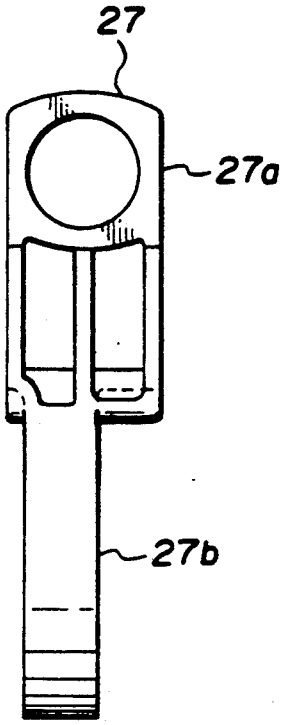
Figure 6C:
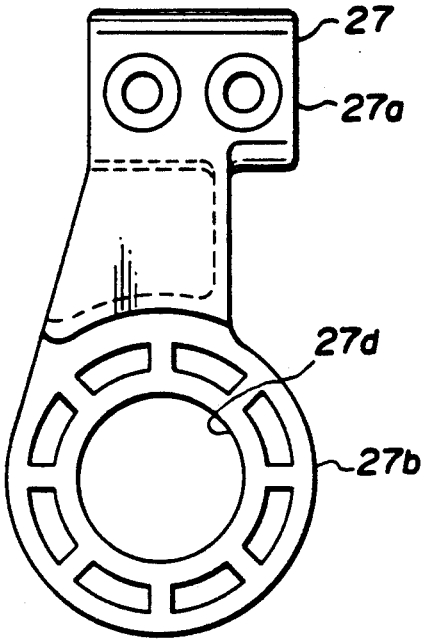
Figure 6D:
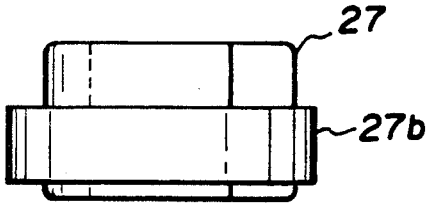
Figure 7A:
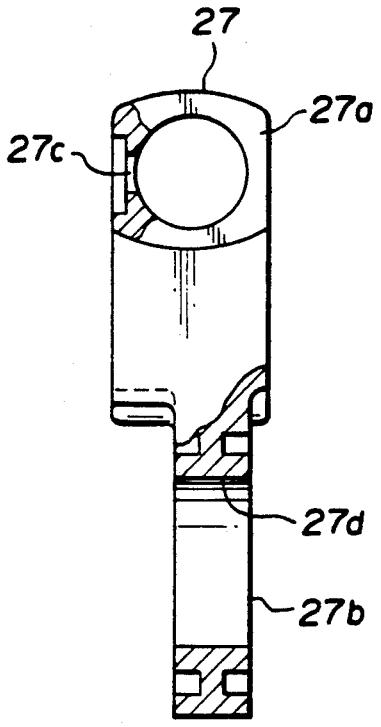
Figure 7B:
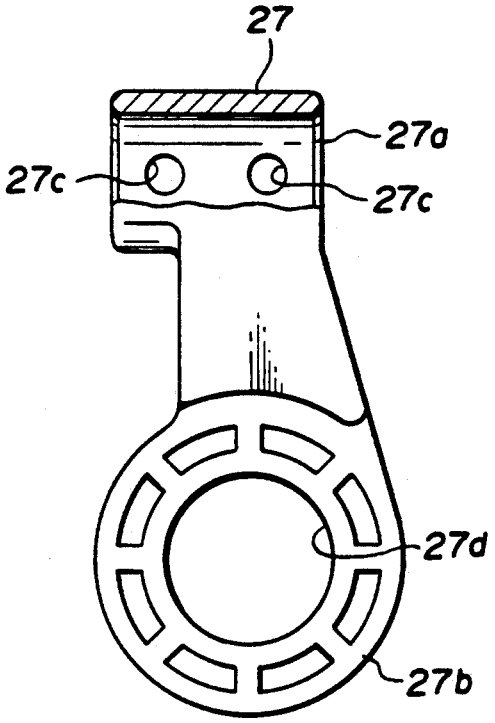

As shown in FIGS. 4A to 4C, a cylindrical projection 22*e* and a square projection 22*f* are provided on the rear face of the coupling section 22*a* of the clutch base 22. More specifically, as better seen in FIG. 5A, the square projection 22*f* protruding rearwards from the cylindrical projection 22*e* is surrounded by an annular groove formed in the former and provided with a center bore 22*g* concentric with the annular groove. An annular depression 22*h* is formed in the coupling section 22*a* of the clutch base 22 concentrically surrounding the cylindrical projection 22*e* on the rear face.

The clutch arm 27 is preferably made of, for example, a zinc die cast and its construction is shown in detail in FIGS. 6A to 6D, 7A and 7B, respectively. The clutch arm 27 is also made up of a coupling section 27*a* and a connecting section 27*b* formed in one body with each other. The coupling section 27*a* is adapted for combination with the arm holder shaft 28 whereas the connecting section 27*b* is adapted for combination with the clutch base 22. Threaded bores 27*c* are formed through the coupling section 27*a*. For combination with the arm holder shaft 28, the coupling section 27*a* is inserted over the top end section of the arm holder shaft 28 and small screws 29 are inserted into the threaded bores 27*c* in order to fix the combination.

The connecting section 27*b* of the clutch arm 27 is provided with a center bore 27*d* for acceptance of the cylindrical projection 22*e* on the connecting section 22*b* of the clutch base 22 when the clutch arm 27 is combined with the clutch base 22.

The construction of the arm base 30 is best seen in FIG. 1. The arm base 30 has three radial branches spaced equally and arms 31 for holding a percussion musical instrument such as a snare drum are fixed, via rivets 32, at their proximal ends 31*a* to the distal ends 30*a* to 30*c* of the three branches of the arm base 30.

Figure 8A:
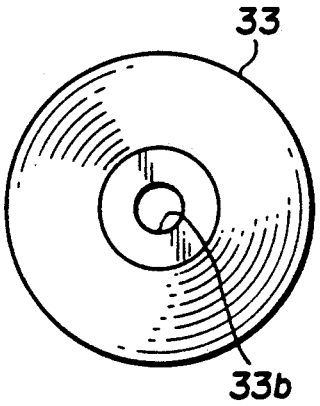
Figure 8B:
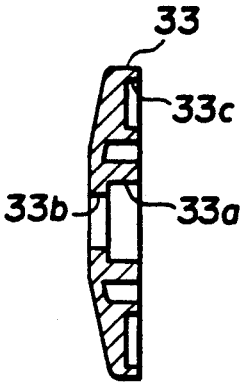
Figure 8C:
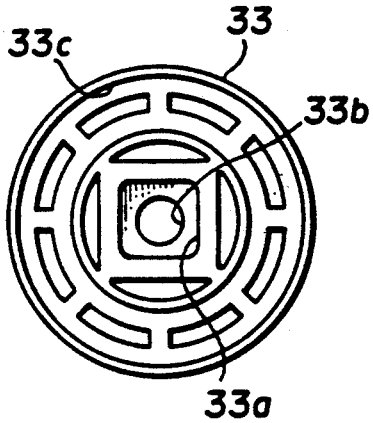
Figure 9A:
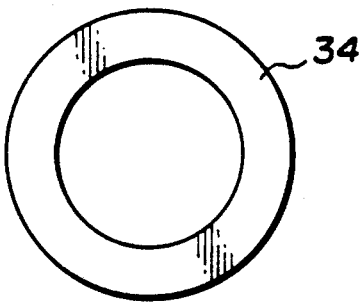
Figure 9B:
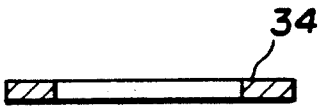

The construction of the clutch cap 33 is shown in detail in FIGS. 8A to 8C. This clutch cap 33 is preferably made of, for example, a zinc die cast. The clutch cap 33 is disc-shaped and provided with a center bore 33*b* opening in its front face. The clutch cap 33 is further provided in its rear face, with a square depression 33*a* in communication with the center bore 33*b* and an annular depression 33*c* surrounding the square depression 33*a*. When the clutch cap 33 is combined with the clutch base 22 as best seen in FIG. 1, the square depression 33*a* in the clutch cap 33 accommodates the square projection on the clutch base 22. In this combination, annular clutch rubbers 34 such as shown in FIGS. 9A and 9B are interposed between the clutch base 22 and the clutch cap 33. More specifically, as shown in FIG. 1, the clutch rubbers 34 are received in an annular space defined by the annular depression 22*h* in the clutch base 22 and the annular depression 33*c* in the clutch cap 33.

A fastening bolt 35 is inserted through the center bore 22*g* in the clutch base 22, the center bore 27*d* in the clutch arm 27 and the center bore 33*b* in the clutch cap 33 in screw engagement with an wing nut 36 in order to fasten a combination of the clutch base 22 with the clutch arm 27 and the clutch cap 33.

With the above-described construction of the connecting unit in accordance with the present invention, the upper pipe 23 of the stand is combined with the arm holder shaft 28 at a selected cross angle in the following sequence. First, the wing nut 36 is loosen to liberate the above-described combination and, whilst manually holding the upper pipe 23, the arm base 30 is pushed upward or downward until the arm holder shaft 28 assumes a position of the selected cross angle relative the upper pipe 23 of the stand. When setting of the position is complete, the wing nut 36 is fasten. By this fastening of the wing nut 36, the square projection 22*f* on the clutch base 22 is brought into engagement with the square depression 33*a* in the clutch cap 33 so that their engagement should inhibit relative rotation between the clutch base 22 and the clutch cap 33. Concurrently, the clutch arm 27 is firmly sandwiched between the clutch base 22 and the clutch cap 33.

The bolt-nut combination firmly fastens the clutch base 22, the clutch rubbers 34, the clutch arm 27 and the clutch cap 33 in the axial direction of the bolt 35 and frictional contact via the clutch rubbers 34 well fortifies the fastened combination.

It is clear from the foregoing description, the connecting unit in accordance with the present invention enables a combination of two supporting elements at any selected cross angle and the combination can be fastened quite reliably.

I claim:

1. A connecting unit of a stand for percussion musical instruments comprising a first connecting element attached at a first end to one of two supporting elements are adapted to be combined with each other at a selected cross angle, said first connecting element being provided at a second end with a circular bore, a second connecting element attached at a first end to the other of said two supporting elements and coupled at a second end to one side of said second end of said first connecting element, said second connecting element being provided on said second end with a cylindrical projection inserted into said center bore in said first connecting element and an angled projection protruding from said cylindrical projection beyond said center bore in said first connecting element, a locking element coupled to the other side of said second end of said first connecting element and provided with an angled depression tightly receptive of said angled projection on said second connecting element, said angled depression and said angled projection each being square in transverse cross section, and means for fastening a combination of said three elements in the direction of combination.

2. A connecting unit as claimed in claim 1 further comprising at least one planar elastic element inserted between adjacent elements in said combination.

* * * * *